United States Patent [19]

Wolber et al.

[11] 4,263,667

[45] Apr. 21, 1981

[54] METHODS AND APPARATUS FOR ASSEMBLING AN ELECTRICAL INSTRUMENT

[75] Inventors: Robert Wolber; Roland Maurer, both of Lauterbach; Peter Jesse, Schramberg, all of Fed. Rep. of Germany

[73] Assignee: Gebruder Junghans GmbH, Schramberg, Fed. Rep. of Germany

[21] Appl. No.: 68,596

[22] Filed: Aug. 22, 1979

[30] Foreign Application Priority Data

Sep. 12, 1978 [DE] Fed. Rep. of Germany ..... 2839555

[51] Int. Cl.[3] ..... G04B 37/00

[52] U.S. Cl. ..... 368/300; 368/88; 368/204

[58] Field of Search ..... 58/23 R, 23 D, 23 BA, 58/53, 54–56, 88 R; 29/625, 626, 851; 361/400, 403; 310/40 MM, 49 R, 162–164, 258; 368/88, 204, 300

[56] References Cited

U.S. PATENT DOCUMENTS

| | | | |
|---|---|---|---|
| 2,909,685 | 10/1959 | Szabo | 310/258 |
| 2,912,481 | 11/1959 | Backus et al. | 29/626 |
| 3,981,139 | 9/1976 | Jackle | 58/23 R |
| 4,121,413 | 10/1978 | Kissinger et al. | 58/23 R X |
| 4,175,374 | 11/1979 | Yoshizawa | 58/23 R |

FOREIGN PATENT DOCUMENTS

| | | |
|---|---|---|
| 2342544 | 10/1975 | Fed. Rep. of Germany . |
| 2403289 | 5/1976 | Fed. Rep. of Germany . |

OTHER PUBLICATIONS pp. 225–227 of German technical treatise, "Philips' Technische Rundschau", 1959 (No. 8).

*Primary Examiner*—Ulysses Weldon

*Attorney, Agent, or Firm*—Burns, Doane, Swecker & Mathis

[57] ABSTRACT

A drive arrangement within a small electric instrument, especially a battery-operated electronic clock, includes a circuit board. Mounted on the circuit board, in addition to the electronic circuitry, are at least the static components of a motor which can be mounted on the circuit board prior to its installation. The circuit board and such static components can thus be inserted as a unit into the clock housing and into suitably designed receiving elements. The receiving elements position the circuit board, as well as the components arranged thereon, into the proper locational relation to the other parts of the motor or clock. The circuit board is held in place after its insertion into the housing by a battery contact spring which is designed in the form of a knife-edged contact and which presses laterally against the circuit board, thus holding the board in its inserted position without the need for additional fastening means. This specific type of holding of the circuit board makes possible a quick installation of same, and also a particularly simple disassembly thereof for making repairs.

8 Claims, 8 Drawing Figures

METHODS AND APPARATUS FOR ASSEMBLING AN ELECTRICAL INSTRUMENT

BACKGROUND OF THE INVENTION

This invention concerns a drive arrangement within a small electric instrument, especially a battery-operated electronic clock of the type which includes a motor comprising a coil, at least two stator laminations and a rotor, the motor being arranged in a casing together with a circuit board which contains an electronic circuitry.

All components of presently known small electric instruments, especially clocks with a stepping motor drive, are designed in the form of individual parts and are mounted within bearings suitable for such parts. This holds true not only for parts of a clockwork but also for circuit boards, the stepping motor, battery contact elements and the like. The independent suspension or mounting of these components, however, requires a substantial number of separate steps to accomplish their individual assembly, and it becomes usually necessary to provide several fastening elements in order to hold these parts in their mounted position.

In view of these circumstances it is the object of the invention to provide a drive arrangement within a small electric instrument, especially a battery-operated clock, which is simple in construction and initial assembly.

It is another object of the invention to provide such a drive arrangement which can be inserted in the casing of the instrument without the need of additional adjustments and which can be removed from the casing in the same manner. The invention solves this problem in which static components of a drive mechanism, e.g., the coil, stator laminations and circuit board are assembled together, before installation as a unit within the housing of the instrument. The housing includes locating elements against which the circuit board is applied to retain the board in a preselected position within the housing.

The placement of at least the static parts of the motor on the circuit board results in a module that can be assembled prior to its installation and which can be inserted into, and removed from, the casing of the instrument by practically one single manipulation. However, it is also possible, depending on the type of the specific instrument, to pre-assemble on the circuit board, without any difficulties, other components of the instrument in addition to the static parts of the motor, thus reducing in all instances the number of separate components which require separate installation, or insertion and fastening within the casing.

THE DRAWINGS

The invention will be described below in detail with reference to a preferred embodiment of the invention in the form of a clock that is illustrated by the drawings, wherein.

DETAILED DESCRIPTION OF A PREFERRED EMBODIMENT OF THE INVENTION

Figure 1:
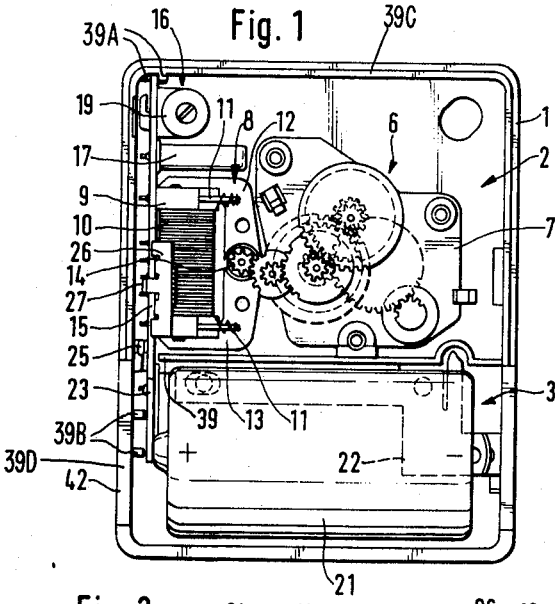
FIG. 1 is a rear view of a clock with a motor arrangement according to the invention where the rear portion of the casing has been removed.
Figure 2:
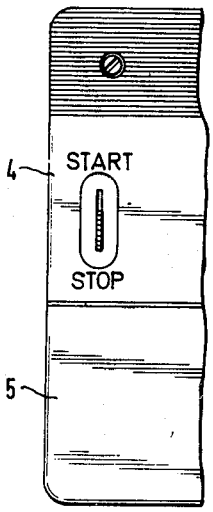
FIG. 2 is a partial rear view of the clock, with the rear portion of the casing inserted.

A clock illustrated in the drawing for the purpose of explaining the invention includes a front housing or casing section 1 having a clockwork area 2 and a battery area 3, as well as a rear housing section 4 having a battery area cover 5. Both housing sections 1, 4 are made of synthetic material and are coupled by shape and by mechanical forces by means of notches and grooves arranged on these sections, a coupling which is releasable. The clock further includes indicator hands (not shown) and a hand-driving clockwork 6, the components of which are arranged within a space located between the bottom of the front housing section 1 and a partition 7, as well as within a space between this partition and the bottom of the rear housing section 4. The clockwork 6 rests on appropriately designed mounting elements.

This clock contains further a drive arrangement with a stepping motor 8 which comprises a coil, two stacks of stator laminations 12, 13, and a rotor 14. The coil includes a winding support or coil former 9, a winding 10, and coil terminal pins 11. A pinion of the rotor meshes with the first wheel of the clockwork 6 in a conventional manner.

Figure 3:
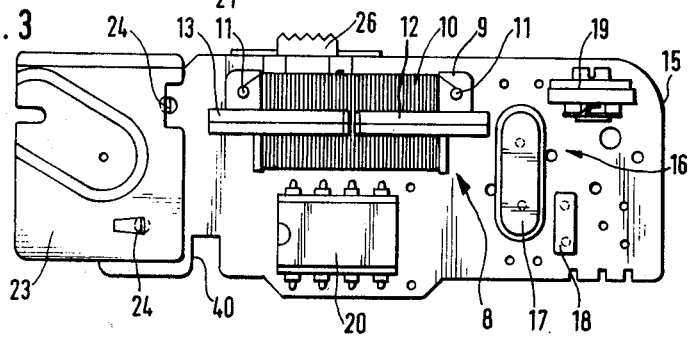
FIG. 3 is a side view of a circuit board with various components of the drive arrangement mounted on the board.

There is further provided a circuit board 15 which is imprinted on one side and which carries at its other side, among other items, various components of an electronic circuitry, the latter comprising a quartz resonator 17, a fixed capacitor 18, a trimmer capacitor 19 and an integrated circuit 20, as shown especially in FIG. 3. These components of the electronic circuitry are connected electrically with each other by electric paths of the circuit board 15.

These components are supplied with electric current by a battery 21, the negative terminal of which being electrically connected to the circuit board by a negative contact spring 22. The spring 22 is fastened at the front casing section 1 and makes contact with the terminal as well as with the circuit board. The positive terminal of the battery is connected to the appropriate paths of the circuit board by means of a positive contact plate 23.

Figure 4:
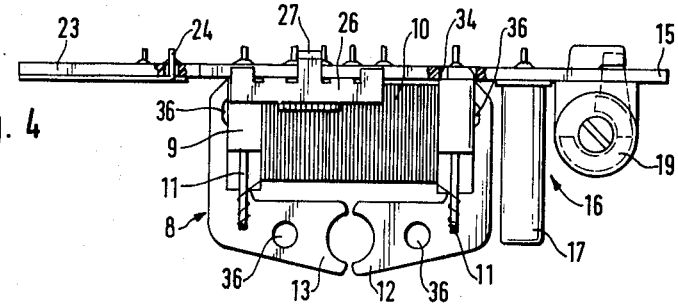
FIG. 4 is a plan view of the arrangement shown in FIG. 3.

The positive contact plate 23 is designed in the form of a punched-out flexible metal part and is soldered to the appropriate paths of the circuit board by means of bent pins 24 (see FIG. 4) which pass through bores of this board.

An arm 25 of the negative contact spring 22 which makes contact with the circuit board 15, is designed in the form of a knife-edge contact which will apply a force component in the direction of the circuit board, thus holding it in its installed position. Details of the spring 22 are available from above-mentioned U.S. Application Ser. Nos. 68,590 and 68,620.

On the circuit board 15 there is further mounted a slide switch 26 which can be moved along one of the edges of the board. Depending on its position, the switch 26 either makes or breaks the pulse feed from the integrated circuit 20 to the coil of the stepping motor by means of spring contacts 27 which are attached to this switch and which co-act with the appropriate paths of the board.

Figure 5:
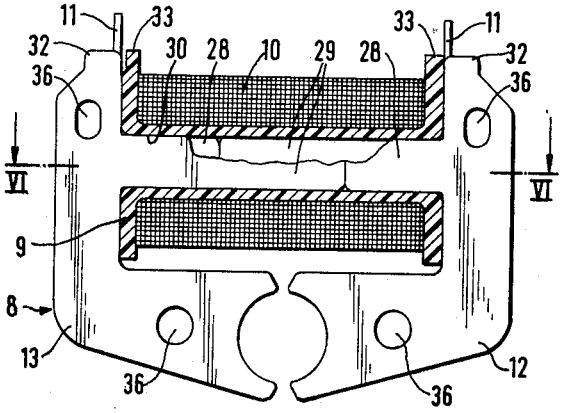
FIG. 5 depicts a stepping motor used in the drive arrangement of the invention.
Figure 6:
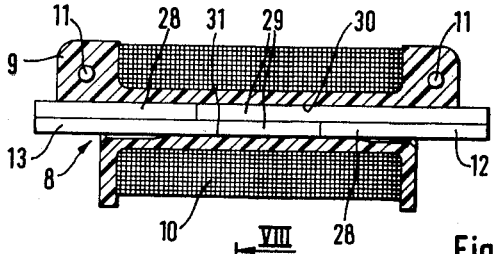
FIG. 6 is a sectional view of the stepping motor taken along line VI—VI in FIG. 5.

Each of the two stacks of stator laminations 12 and 13 is formed by two stator laminations which carry fastening arms 28 and 29, respectively. The arms 28, 29 differ in their length as illustrated in detail in FIG. 5 and the longer fastening arms 29 overlap and the front end of each arm 29 fits snugly against the shorter arm of the other stator lamination 28. The stacks of stator laminations 12 and 13 are inserted by means of these fastening arms 28 and 29 into a through-bore 30 of the winding support 9 so that they will be able to encompass the latter. This through-bore 30 has a substantially rectangular profile of such dimension that the inserted stator laminations 12, 13, which are positively held in place in the direction of their width by means of a protruding pressure shoulder 31 on a side wall of the through-bore 30 (see FIG. 6), can be moved slightly in the cross-direction relative to each other.

On the individual stator laminations of the two stacks of stator laminations 12 and 13, as well as on the winding support 9, there are arranged fastening projections 32 and 33, respectively, which penetrate associated perforations 34 of the circuit board 15. (See the aforementioned U.S. Application Ser. No. 68,591 (for additional details).

The circuit board also includes bores to accommodate the coil terminal pins 11. These pins 11 are soldered to the associated paths so that the coil can be fastened to the circuit board without the use of any additional fastening means, while at the same time the two stacks of stator laminations are being attached, preliminarily but safely, to the circuit board. However, it is also possible to fasten the coil to the circuit board 15 by providing the coil with springy locking elements which are engaging the area surrounding the perforations 34 of the circuit board 15.

Figure 8:
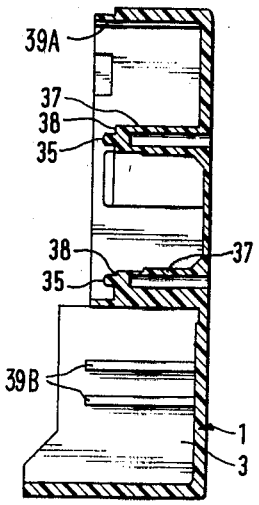
FIG. 8 is a sectional view of the casing part taken along line VIII—VIII in FIG. 7.
Figure 7:
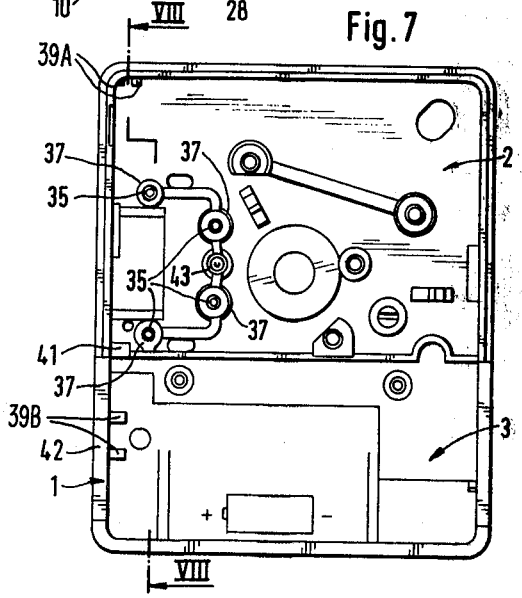
FIG. 7 is a rear view of the casing of the clock illustrated in FIG. 1 with the drive components removed.

A final fastening of the stator laminations of the two stacks of stator laminations 12 and 13, relative to each other as well as relative to the rotor 14 and the other components of the clock, is accomplished by means of holding pins 35 (see FIGS. 7 and 8). Such pins 35 penetrate bores or perforations 36 (see FIG. 5) of the stator laminations and are arranged at the upper end of supports 37, attached to the front housing section 1. These supports 37 are further equipped with bearing surfaces 38 upon which the stacks of stator laminations 12 and 13 can rest. Another support 43 is provided which carries a mount for the axle of rotor 14.

The circuit board 15 is held within the front housing section 1 parallel with the rotor axis by appropriately designed locating or retaining elements, including guiding ribs 39A and 39B. The ribs 39A comprise a pair of spaced ribs arranged on an upper wall 39C of the housing between which an end of the circuit board is inserted, to limit movement of the board laterally, i.e., in a direction perpendicular to the plane of the board. The ribs 39B are arranged on a side wall 39D of the housing and limit travel of the circuit board when the latter is pressed thereagainst by the contact spring 22. The position of the circuit board 15 is secured in longitudinal direction by a locking recess 40 (see FIG. 3) which is engaged by a transversal rib 41 (see FIG. 7) arranged on the front housing section 1.

The assembly of the arrangement described above will now be explained in greater detail with reference to a number of operational steps.

Firstly, the two stacks of stator laminations 12 and 13 (with the fastening arms 28 and 29 attached to the individual stator laminations) are inserted into the through-bore 30 of the coil former 9.

The coil is then attached in the course of a second operation to the circuit board 15, whereby (a) the coil terminal pins 11 are pushed through appropriate bores of the circuit board and (b) the fastening projections of the coil former 9 and of the stator laminations are inserted into the two perforations 34 of the circuit board 15. By so doing, the position of the stator laminations is temporarily fixed.

In the course of the next operation, the coil terminal pins are soldered to the associated paths of the circuit board 15. The coil and the two stacks of stator laminations are now securely connected with the circuit board.

During the next operation, the circuit board, carrying the pre-assembled components of the motor arrangement, is pushed into the housing and against the receiving elements provided therein. In the course of this step, the stator laminations of the two stacks of stator laminations 12 and 13 are placed into their final and correct positions relative to each other as well as relative to the rotor 14 by the holding pins 35 which penetrate their accommodating bores 36.

At the time of the insertion of the circuit board into the housing, the reed 25 of the negative contact spring 22, which is designed in the form of a knife-edge contact, is deflected laterally. Accordingly, there is created a force component acting against the housing wall 42 and the circuit board, causing the latter to be pressed against the guide ribs 39 so that the board is held in its inserted position without the use of additional fastening means.

Although the invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A drive arrangement in a small electric instrument, such as a battery powered watch, having a housing, said drive arrangement being of the type comprising:

a motor including a coil wrapped around a coil support, a stator sheet lamination formed of at least two stator laminations mounted on said bobbin, and a driven rotor;

a printed circuit board carrying said coil support and said stator laminations which are mounted on said coil support, and including a printed electrical circuit for actuating said motor;

said housing including ribs for positioning and securing said circuit board in said housing as said circuit board with said coil and stator laminations is installed as a unit into said housing; and holding pins integral with said housing for entering holes in said stator laminations to hold the latter in proper orientation as said circuit board is installed into said housing;

the improvement wherein:

said coil includes terminal pins which extend through said circuit board and are electrically and mechanically connected thereto to hold said coil and stator laminations to said circuit board prior to installation into said housing;

said stator laminations are movable relative to said circuit board when carried thereby prior to entry of said holding pins into said holes so that said stator laminations may move relative to said circuit board and into accurate alignment with said holding pins.

2. Apparatus according to claim 1, wherein said coil former includes a through-bore of substantially rectangular profile, each stator lamination carrying a fastening arm disposed in said through-bore and frictionally engaging opposite side walls of said through-bore.

3. Apparatus according to claim 2, wherein said motor includes two stacks of stator laminations, each containing at least two stator laminations, the stator laminations of each stack being identical and carrying fastening arms which differ in length and which are mounted within said through-bore in such manner that the longer fastening arms overlap, the front end of each said longer fastening arm fitting snugly against the shorter arm of the other stator lamination.

4. Apparatus according to claim 2 wherein said fastening arms are relatively movable in a direction parallel to the axis of said through-bore in order to compensate for variations in tolerance.

5. Apparatus according to claim 1 wherein said instrument comprises a battery-operated clock.

6. A drive arrangement as defined by claim 1 wherein said coil former includes a through-bore receiving said stator laminations, said through-bore including a pressure shoulder to bear against said stator laminations and secure the latter against movement in the direction of the thickness of the stator laminations.

7. A drive arrangement according to claim 1 wherein said circuit board is positioned adjacent a partition plate, output drive gears being disposed on opposite sides of said partition plate.

8. A drive arrangement according to claim 1 wherein said housing includes a battery compartment for receiving a battery, said circuit board including a portion which is co-planar with the remainder of said circuit board and which extends into said battery compartment to make electrical connection with the battery.

* * * * *